US010444658B2

(12) United States Patent
Noguchi et al.

(10) Patent No.: US 10,444,658 B2
(45) Date of Patent: Oct. 15, 2019

(54) IMAGE FORMING APPARATUS HAVING DEVELOPER TRANSPORTING MEMBER THAT TRANSPORTS DEVELOPER TOWARD A DEVELOPER BEARING MEMBER

(71) Applicant: CANON KABUSHIKI KAISHA, Tokyo (JP)

(72) Inventors: Bunro Noguchi, Mishima (JP); Hisashi Yamauchi, Numazu (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/916,836

(22) Filed: Mar. 9, 2018

(65) Prior Publication Data

US 2018/0210368 A1 Jul. 26, 2018

Related U.S. Application Data

(63) Continuation of application No. 15/458,537, filed on Mar. 14, 2017, now Pat. No. 9,946,188.

(30) Foreign Application Priority Data

Mar. 22, 2016 (JP) ..... 2016-057651

(51) Int. Cl.
*G03G 15/06* (2006.01)

(52) U.S. Cl.
CPC ... *G03G 15/065* (2013.01); *G03G 2215/0132* (2013.01)

(58) Field of Classification Search
CPC ..... G03G 15/065; G03G 2215/0132
See application file for complete search history.

(56) References Cited

U.S. PATENT DOCUMENTS 5,404,211 A 4/1995 Hashimoto et al.
5,628,043 A * 5/1997 Ikeda ..... G03G 13/08 399/236

(Continued)

FOREIGN PATENT DOCUMENTS

JP H08227222 A 9/1996
JP H0915976 A 1/1997
JP 2010079286 A 4/2010

OTHER PUBLICATIONS

Notice of Allowance issued in U.S. Appl. No. 15/458,537 dated Dec. 11, 2017.

*Primary Examiner* — G. M. A Hyder
(74) *Attorney, Agent, or Firm* — Rossi, Kimms & McDowell LLP

(57) ABSTRACT

An image forming apparatus is capable of performing a second image forming operation in which a peripheral velocity ratio of a developer bearing member to an image bearing member becomes greater than that in a first image forming operation, and in which a potential difference between a developing bias applied to the developer bearing member and a supply bias applied to a supply member becomes a potential difference at which a urging force causing a developer at the contact portion between the developer bearing member and the supply member to move from the supply member to the developer bearing member becomes smaller than that in the first image forming operation, or becomes a potential difference at which a urging force causing the developer to move from the developer bearing member to the supply member is generated.

5 Claims, 11 Drawing Sheets

(56) References Cited

U.S. PATENT DOCUMENTS

| | | | | |
|---|---|---|---|---|
| 5,826,144 | A | 10/1998 | Takenaka et al. | |
| 8,190,044 | B2 | 5/2012 | Kitamura et al. | |
| 9,057,976 | B2 | 6/2015 | Yoshida et al. | |
| 2006/0127133 | A1* | 6/2006 | Suzuki | G03G 15/06 399/167 |
| 2010/0054780 | A1 | 3/2010 | Kitamura et al. | |
| 2011/0123205 | A1* | 5/2011 | Satomura | G03G 15/0856 399/27 |
| 2014/0119757 | A1 | 5/2014 | Yoshida et al. | |

* cited by examiner

IMAGE FORMING APPARATUS HAVING DEVELOPER TRANSPORTING MEMBER THAT TRANSPORTS DEVELOPER TOWARD A DEVELOPER BEARING MEMBER

BACKGROUND OF THE INVENTION

Field of the Invention

The present invention relates to an image forming apparatus by using an electrophotographic system.

Description of the Related Art

In an image forming apparatus that forms an image on a recording material using an electrophotographic system such as a copier, a printer, and a facsimile machine, a configuration including a developing apparatus for visualizing an electrostatic latent image with nonmagnetic one-component toner has been known. As such a developing apparatus, there has been known one including a developing roller serving as a developer bearing member that bears and transports toner and a supply roller serving as a developer supply member that is arranged around the developing roller and supplies the toner to the developing roller. In the developing apparatus, the toner is supplied to the developing roller while being friction-charged by the mechanical rubbing between the supply roller and the developing roller. The supplied toner is controlled to have a certain thickness on the developing roller by a developer control member, and then transported to a developing region representing the adjacent region between the developing roller and a photosensitive drum serving as an electrostatic latent image bearing member to visualize an electrostatic latent image as a toner image.

Residual toner on the developing roller (hereinafter called "development residual toner") that has not been used for developing in the developing region is scraped from the developing roller by the mechanical rubbing between the supply roller and the developing roller at the contact portion between the developing roller and the supply roller. At the same time, the toner is supplied from the supply roller to the developing roller. On the other hand, the scraped toner is mixed with toner inside and around the supply roller. Moreover, there has been generally used a method for applying a bias for generating the potential difference between a developing roller and a supply roller to supply toner from the supply roller to the developing roller and collect the toner from the developing roller with an electrostatic force (Japanese Patent Application Laid-open No. H9-15976). In Japanese Patent Application Laid-open No. H9-15976, there has been proposed a method for performing control to apply a bias for collecting the toner on an intermediate roller corresponding the developing roller during an image forming period and apply a bias for forming a toner layer on the intermediate roller during a non-image forming period.

Meanwhile, for an image formed by a series of image forming operations, an image and density intended by a user need to be output. In addition, in a full-color image generated by a plurality of image forming stations, the reproducibility of a tinge becomes important. Therefore, for the purpose of increasing the selection range of a tinge, there has been generally used a method for changing the rotation speed of a developing roller to change the peripheral velocity ratio of the developing roller with respect to a photosensitive drum (Japanese Patent Application Laid-open No. H8-227222). Hereinafter, an image forming operation in which the amount of supplied toner per unit area from a developing roller to a photosensitive drum is increased to increase density or color gamut will be called "high-density mode."

SUMMARY OF THE INVENTION

However, when the high-density mode is performed in a configuration as shown in Japanese Patent Application Laid-open No. H9-15976, there is a likelihood that an uneven density image in a supply roller cycle (hereinafter called an "uneven density image") occurs particularly at the rear end of an image. Such an uneven density image is likely to occur when an elastic sponge is used as the material of a supply roller, i.e., when a configuration includes a supply roller configured to be capable of retaining toner at fine irregularities on the sponge front surface made of a foaming body layer. The amount of the toner necessary for image formation is increased in the high-density mode. For this reason, if the toner is continuously supplied from a supply roller to a developing roller by a bias during the image formation, the toner inside the supply roller (the toner retained by the supply toner) is exhausted. Since the toner is unevenly supplied from the supply roller to the developing roller at this time, a toner layer thickness on the developing roller also become uneven, which results in an uneven density image.

The present invention has an object of providing a technology by which it is possible to reduce the occurrence of an uneven density image when an image forming operation to increase the amount of toner necessary for image formation per unit area is performed.

In order to achieve the above object, an image forming apparatus according to the present invention includes:

a developer bearing member that develops an electrostatic image with a developer, the electrostatic image being formed on an image bearing member; and a supply member that is arranged in contact with the developer bearing member and supplies the developer to the developer bearing member, wherein the image forming apparatus is capable of performing a first image forming operation in which an image is formed at a first peripheral velocity ratio representing a ratio of a peripheral velocity of the developer bearing member to a peripheral velocity of the image bearing member and a second image forming operation in which an image is formed at a second peripheral velocity ratio, which is greater than the first peripheral velocity ratio, and a developing bias applied to the developer bearing member and a supply bias applied to the supply member are set such that a urging force in the second image forming operation becomes smaller than that in the first image forming operation, the urging force causing the developer at a contact portion between the developer bearing member and the supply member to move from the supply member to the developer bearing member, by a potential difference between the developing bias and the supply bias.

In order to achieve the above object, an image forming apparatus according to the present invention includes:

a rotatable developer bearing member that develops an electrostatic image with a developer, the electrostatic image being formed on an image bearing member;

a rotatable supply member that is arranged in contact with the developer bearing member and supplies the developer to the developer bearing member; and a driving portion that rotates the image bearing member and the developer bearing member, wherein the image forming apparatus is capable of performing a first image forming operation in which an image is formed at a first peripheral velocity ratio representing a ratio of a peripheral velocity of the developer bearing member to a peripheral velocity of the image bearing member and a second image forming operation in which an image is formed at a second peripheral velocity ratio, which is greater than the first peripheral velocity ratio, and a developing bias applied to the developer bearing member and a supply bias applied to the supply member are set such that a urging direction of a urging force in the second image forming operation becomes opposite to that in the first image forming operation, the urging force causing the developer at a contact portion between the developer bearing member and the supply member to move between the developer bearing member and the supply member, by a potential difference between the developing bias and the supply bias.

According to the present invention, it is possible to reduce the occurrence of an uneven density image when an image forming operation to increase the amount of toner necessary for image formation per unit area is performed.

Further features of the present invention will become apparent from the following description of exemplary embodiments with reference to the attached drawings.

DESCRIPTION OF THE EMBODIMENTS

Modes for carrying out the present invention are illustratively explained in detail below on the basis of embodiment with reference to the drawings. However, dimensions, materials, and shapes of components described in the embodiments, relative arrangement of the components, and the like should be changed as appropriate according to the configuration of an apparatus to which the invention is applied and various conditions. That is, the dimensions, the materials, the shapes, and the relative arrangement are not intended to limit the scope of the present invention to the embodiments.

(First Embodiment)

(Image Forming Apparatus)

Figure 1:
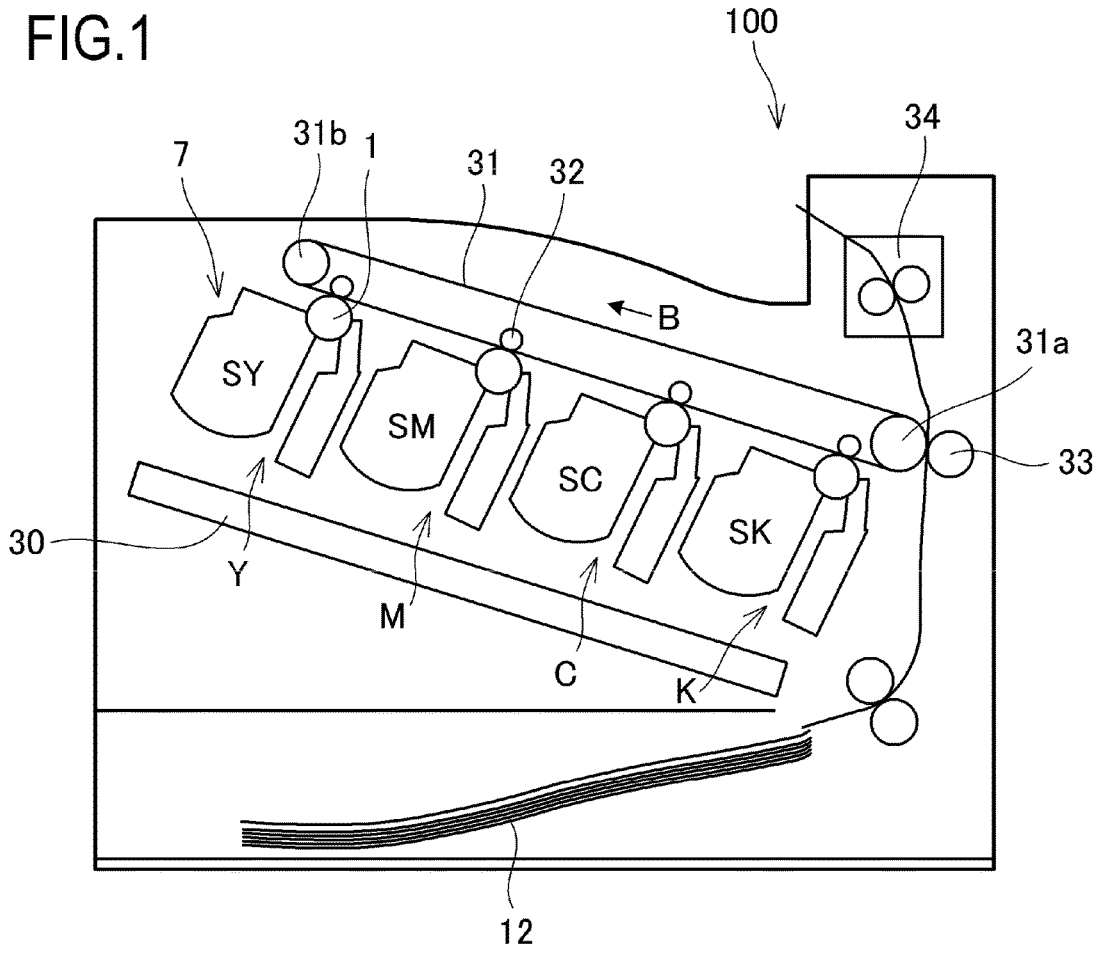
FIG. 1 is a schematic cross-sectional view of an image forming apparatus in an embodiment of the present invention.

A description will be given, with reference to FIG. 1, of the entire configuration of an electrophotographic image forming apparatus (image forming apparatus) according to an embodiment of the present invention. FIG. 1 is a schematic cross-sectional view of an image forming apparatus 100 according to the embodiment. The embodiment will describe, as an example of an image forming apparatus, a case in which the present invention is applied to a full-color laser beam printer with an in-line system and an intermediate transfer system. The image forming apparatus 100 is allowed to form a full-color image on a recording material (such as a recording paper, a plastic sheet, and a fabric) 12 according to image information. The image information is input to an image forming apparatus main body from an image reading apparatus connected to the image forming apparatus main body or host equipment such as a personal computer communicably connected to the image forming apparatus main body.

In the image forming apparatus 100, process cartridges 7 serving as a plurality of image forming portions have image forming portions SY, SM, SC, and SK to form images of the respective colors of yellow (Y), magenta (M), cyan (C), and black (K). In the embodiment, the image forming portions SY, SM, SC, and SK are arranged in a line in a direction crossing a vertical direction. In addition, the process cartridges 7 for the respective colors have the same shape and the same configuration except for a difference in the color of accommodated toner and accommodate the toner of the respective colors of yellow (Y), magenta (M), cyan (C), and black (K). Note that a process cartridge for black, which is frequently used, may be configured to be greater in size than the other three process cartridges.

The process cartridges 7 are attachable/detachable to/from the image forming apparatus main body (hereinafter called the apparatus main body) via attachment portion such as attachment guides and positioning members provided in the apparatus main body. Here, the apparatus main body represents an apparatus configuration part excluding at least the process cartridges 7 from the configuration of the image forming apparatus 100. Note that developing apparatuses 3, which will be described later, alone may be configured to be attachable/detachable to/from the apparatus main body. In this case, an apparatus configuration part excluding the developing apparatuses 3 from the configuration of the image forming apparatus 100 may represent the apparatus main body.

Figure 2:
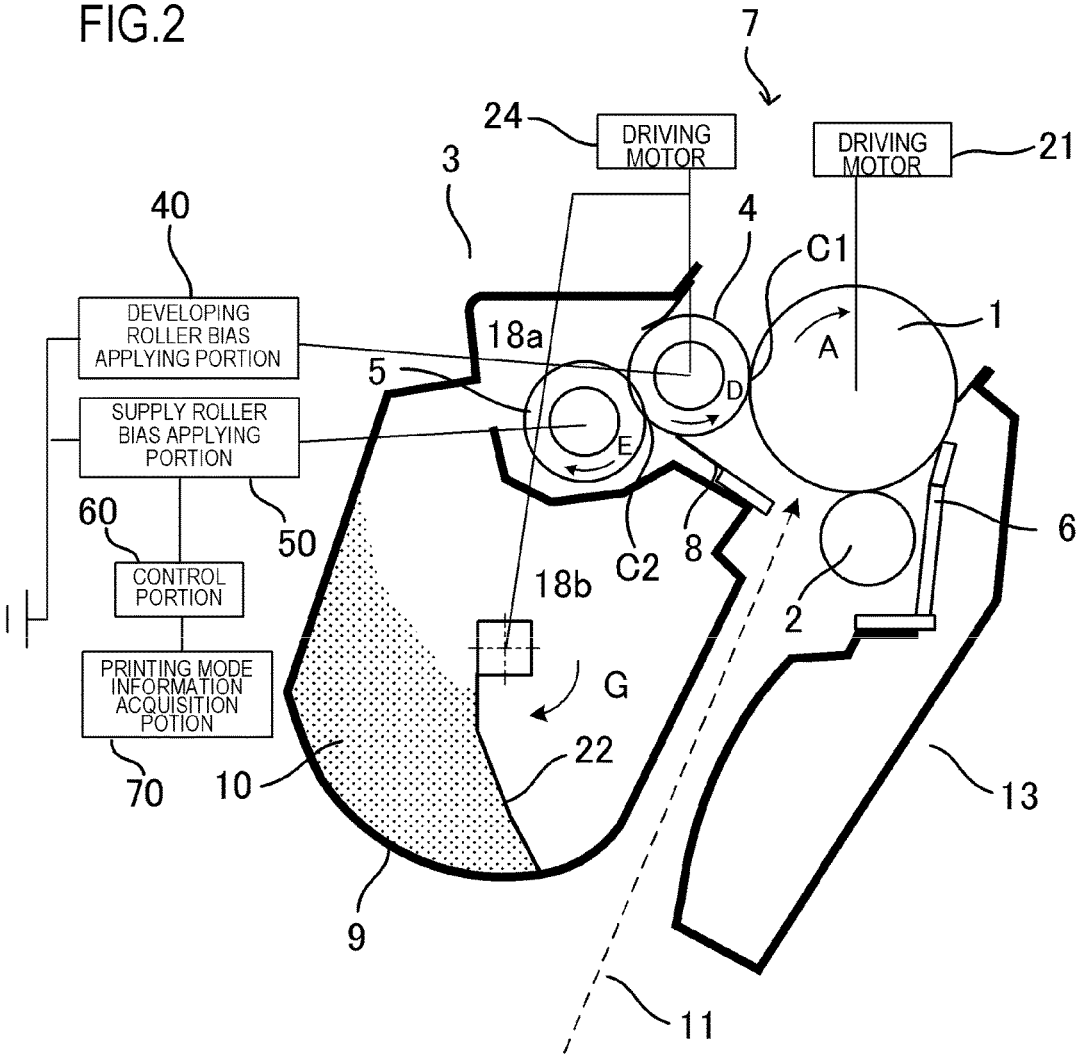
FIG. 2 is a schematic cross-sectional view of a process cartridge in first and third embodiments of the present invention.

Photosensitive drums 1 serving as image bearing members are rotated and driven by a driving motor shown in FIG. 2. A scanner unit 30 serving as an exposure apparatus is exposure portion for irradiating laser based on image information to form an electrostatic image (electrostatic latent image) on the photosensitive drums 1. In a main scanning direction (direction orthogonal to the transporting direction of a recording material 12), the writing of laser exposure is performed for each scanning line according to a position signal inside a polygon scanner called BD. On the other hand, in a sub-scanning direction (transporting direction of the recording material 12), the writing of the laser exposure is performed so as to be delayed by a prescribed time from a ToP signal with a switch (not shown) inside a transporting path for the recording material 12 as a start point. Thus, it becomes possible to constantly perform the laser exposure at the same positions on the photosensitive drums 1 in four process stations Y, M, C, and K.

An intermediate transfer belt 31 serving as an intermediate transfer body to transfer toner images (developer images) on the photosensitive drums 1 onto the recording material 12 is arranged facing the four photosensitive drums 1. The intermediate transfer belt 31 is stretched over between a plurality of supporting members, i.e., a roller 31*a* serving not only as a driving roller but also as a secondary transfer facing roller and a driven roller 31*b*. When the roller 31*a* rotates, the intermediate transfer belt 31 formed of an endless belt serving as an intermediate transfer body comes in contact with all the photosensitive drums 1 and circularly moves (rotates) in an arrow B direction (counterclockwise direction) in FIG. 1. On the side of the inner peripheral surface of the intermediate transfer belt 31, four primary transfer rollers 32 serving as primary transfer portion are arranged side by side so as to face the respective photosensitive drums 1. Then, a bias having a polarity opposite to the regular charging polarity of the toner is applied to the primary transfer rollers 32 from a primary transfer bias power supply (high-voltage power supply) serving as primary transfer bias applying portion not shown. Thus, the toner images on the photosensitive drums 1 are transferred (primarily transferred) onto the intermediate transfer belt 31.

In addition, a secondary transfer roller 33 serving as secondary transfer portion is arranged on the side of the outer peripheral surface of the intermediate transfer belt 31 so as to face the roller 31*a* with the intermediate transfer belt 31 held therebetween. Then, a bias having a polarity opposite to the regular charging polarity of the toner is applied to the secondary transfer roller 33 from a secondary transfer bias power supply (high-voltage power supply) serving as secondary transfer bias applying portion not shown. Thus, the toner images on the intermediate transfer belt 31 are transferred (secondarily transferred) onto the recording material 12. For example, in forming a full-color image, the above process is successively performed by the image forming portions SY, SM, SC, and SK, and toner images of the respective colors are successively overlapped with each other and primarily transferred onto the intermediate transfer belt 31. After that, the recording material 12 is transported to a secondary transfer portion in synchronization with the movement of the intermediate transfer belt 31. Then, by the action of the secondary transfer roller 33 coming in contact with the intermediate transfer belt 31 via the recording material 12, the toner images of the four colors on the intermediate transfer belt 31 are secondarily transferred onto the recording material 12 at once.

The recording material 12 onto which the toner images have been transferred is transported to a fixing apparatus 34 serving as fixing portion. When the recording material 12 is heated and pressed in the fixing apparatus 34, the toner images are fixed onto the recording material 12. After that, the recording material 12 onto which the toner images have been fixed is discharged onto a sheet catching tray provided on the upper surface of the apparatus main body.

(Process Cartridges)

Figure 11:
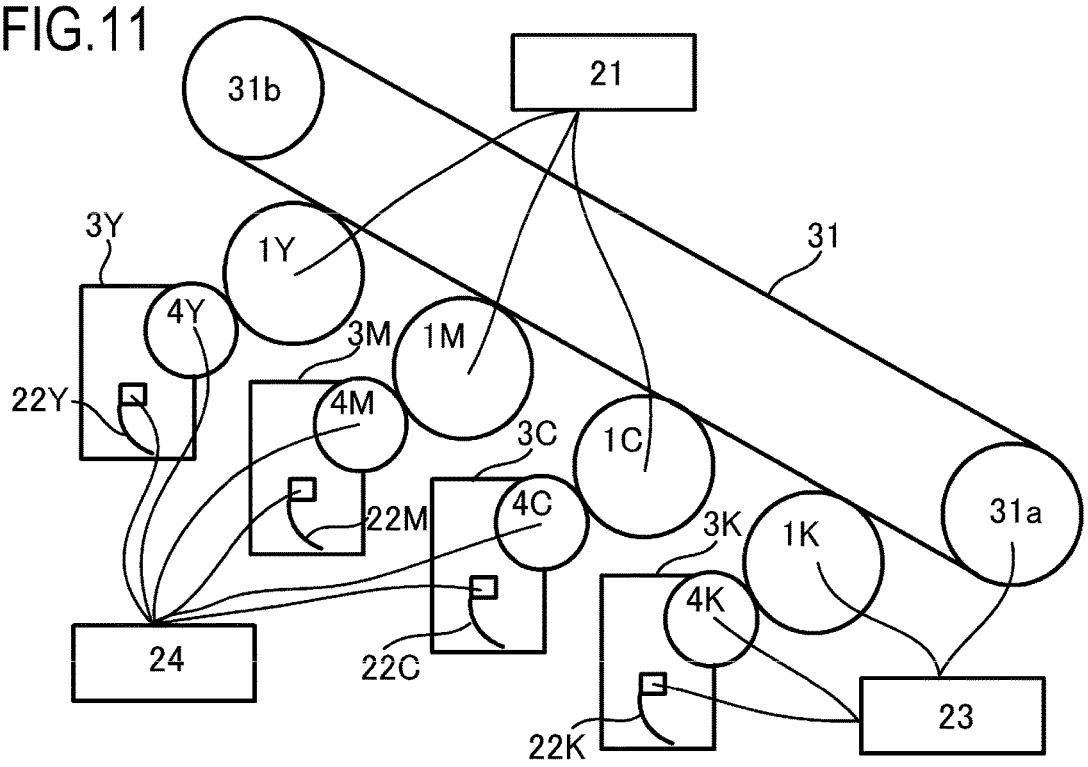
FIG. 11 is a schematic view of driving coupling configurations in the embodiment of the present invention.

A description will be given, with reference to FIG. 2, of the entire configuration of each of the process cartridges 7 attached to the image forming apparatus 100 according to the first embodiment of the present invention. FIG. 2 is a cross-sectional (main cross-sectional) view schematically showing a cross section perpendicular to the longitudinal direction (rotational axis direction) of the photosensitive drum 1 of the process cartridge 7 in the first and third embodiments. Note that in the embodiment, the configurations and the operations of the process cartridges 7 for the respective colors are substantially the same except for the types (colors) of accommodated developers and driving configurations that will be described later. As will be described in detail later, driving configurations shown in FIG. 2 are used by the process cartridges 7 for yellow (Y), magenta (M), and cyan (C) in the embodiment. That is, driving portion (first driving portion) for rotating and driving the photosensitive drums 1 and driving portion for rotating and driving developing rollers 4 are configured to have different driving sources (driving motors). In the process cartridge 7 for black (K), driving portion for rotating and driving the photosensitive drum 1 and driving portion for rotating and driving the developing roller 4 are constituted by one common driving motor as shown in FIG. 11. However, besides the above configurations of the embodiment, any configuration may be used. For example, the photosensitive drums 1 of all the cartridges may be configured to be driven by one driving source (driving motor), and the developing rollers of all the cartridges may be configured to be driven by the other driving source (driving motor).

Each of the process cartridges 7 has a photosensitive member unit 13 including the photosensitive drum 1 or the like and a developing unit 3 including the developing roller 4 or the like serving as a developer bearing member. The photosensitive drum 1 is rotatably attached to the photosensitive member unit 13 via a bearing not shown. The photosensitive drum 1 rotates and drives in an arrow A direction in FIG. 2 according to an image forming operation when receiving a driving force from the driving motor 21 serving as photosensitive drum driving portion. In addition, a charging roller 2 and a cleaning member 6 are arranged in the photosensitive member unit 13 so as to contact the peripheral surface of the photosensitive drum 1. A bias enough to cause any charge to be on the photosensitive drum 1 is applied to the charging roller 2 from a charging bias power supply (high-voltage power supply) serving as charging bias applying portion not shown. In the embodiment, the applied bias is set such that a potential (charged potential: Vd) on the photosensitive drum 1 becomes −500 V. The photosensitive drum 1 having been charged by the charging roller 2 is irradiated with laser 11 from the scanner unit 30 based on image information, and an electrostatic image (electrostatic latent image) is formed on the photosensitive drum 1.

On the other hand, the developing unit 3 includes a container frame body 9 having a developing chamber 18*a* and a developer accommodation chamber 18*b*. The developer accommodation chamber 18*b* is arranged beneath the developing chamber 18*a* and communicates with the developing chamber 18*a* via a communication port provided above the developer accommodation chamber 18*b*. Toner 10 serving as a developer is accommodated inside the developer accommodation chamber 18*b*. In addition, a developer transporting member 22 for transporting the toner 10 to the developing chamber 18*a* is provided in the developer accommodation chamber 18*b*. When the developer transporting member 22 rotates in an arrow G direction in FIG. 2, the toner is transported to the developing chamber 18*a*. Note that the toner 10 used in the embodiment is one whose regular charging polarity is negative and the following description supposes a case in which the negative charging toner is used. However, toner available in the present invention is not limited to the negative charging toner, and toner whose regular charging polarity is positive may be used depending on an apparatus configuration.

In the developing chamber 18*a*, the developing roller 4 is provided that contacts the photosensitive drum 1 and serves as a developer bearing member that rotates in an arrow D direction in FIG. 2 when receiving a driving force from the driving motor 24 serving as developing driving portion. In the embodiment, the developing roller 4 serving as a developer bearing member and the photosensitive drum 1 serving as an image bearing member rotate such that their mutual front surfaces move in the same direction at a contact portion C1 representing a segment at which the toner borne by the developing roller 4 is supplied to the photosensitive drum 1. However, a peripheral velocity difference is generated between the developing roller 4 and the photosensitive drum 1. In the embodiment, the peripheral velocity difference between the developing roller and the photosensitive drum is 150%. In addition, a bias (developing bias) enough to develop and visualize an electrostatic latent image on the photosensitive drum 1 is applied to the developing roller 4 from a developing-roller bias power supply (high-voltage power supply) 40 serving as developing roller bias applying portion.

Moreover, in the developing chamber 18*a*, a toner supply roller (hereinafter called a supply roller) 5 and a toner amount control member (hereinafter called a control member) 8 are arranged. The supply roller 5 serving as a supply member is a roller for supplying the toner having been transported from the developer accommodation chamber 18*b* to the developing roller 4 serving as a developer bearing member. The control member 8 controls the coating amount of the toner on the developing roller 4 having been supplied by the supply roller 5 and applies charges. A bias (supply bias) is supplied to the supply roller 5 from a supply-roller bias power supply (high-voltage power supply) 50 serving as supply roller bias applying portion.

Here, the biases applied from the developing-roller bias power supply 40 and the supply-roller bias power supply 50 are controlled by a control portion 60 based on information acquired by a printing mode information acquisition portion 70. The information acquired by the printing mode information acquisition portion 70 is information input from the operation panel and the printer driver (not shown) of the image forming apparatus 100, or the like.

The supply roller 5 serving as a supply member is an elastic sponge roller in which a foaming body layer is formed on the outer periphery of a conductive cored bar and is disposed to have a prescribed contact portion C2 on the peripheral surface of the developing roller 4 at its portion facing the developing roller 4 serving as a developer bearing member. Further, the supply roller 5 rotates in an arrow E direction in FIG. 2 when receiving a driving force from the driving motor 24 serving as developing driving portion. In the embodiment, the developing roller 4 drives and rotates at 100 rpm, and the supply roller 5 drives and rotates at 200 rpm. In addition, the supply roller 5 used in the embodiment has a resistance value of 4×10^6 Ω and a hardness degree of 190 gf. In the embodiment, however, the resistance value is calculated in such a manner as to press the supply roller 5 onto a metal roller having a diameter of 30 φ by about 1 mm and measure a current value with a voltage of 100 V applied. During the measurement, the supply roller 5 rotates at about 200 rpm. In addition, the hardness of the supply roller 5 is a value obtained by measuring a load when a flat plate having a longitudinal width of 50 mm is pressed onto the front surface of the supply roller 5 by 1 mm.

The toner having been supplied to the developing roller 4 by the supply roller 5 enters the contact portion between the control member 8 and the developing roller 4 when the developing roller 4 rotates in the arrow D direction. Then, the toner having been born by the developing roller 4 is friction-charged when the front surface of the developing roller 4 and the control member 8 rub against each other, and its layer thickness is controlled simultaneously when charges are applied to the toner. The toner having been controlled on the developing roller 4 is transported to a portion facing the photosensitive drum 1 when the developing roller 4 rotates to develop and visualize an electrostatic latent image on the photosensitive drum 1 as a toner image. Note that the supply roller 5 serving as a supply member and the developing roller 4 serving as a developer bearing member may be configured to rotate in the same direction, i.e., they may be configured to relatively move (rotate) in opposite directions at the contact portion C2.

Toner (development residual toner) that has not been used for developing and remains in a developing region on the developing roller 4 serving as a developer bearing member enters the contact portion C2 between the developing roller 4 and the supply roller 5 serving as a supply member when the developing roller 4 rotates in the arrow D direction. Some of the development residual toner is collected by the supply roller 5 due to the mechanical rubbing between the developing roller 4 and the supply roller 5 and the potential difference between the developing roller 4 and the supply roller 5, and mixed with toner inside the supply roller 5 and peripheral toner. On the other hand, residual toner on the developing roller 4 that has not been collected by the supply roller 5 out of the development residual toner is given charges when the developing roller 4 and the supply roller 5 rub against each other and at the same time mixed with toner newly supplied from the supply roller 5.

As shown in FIG. 11, the configurations of the driving portion for driving the photosensitive drums 1, the developing rollers 4, and the shafts of the transporting members 22 are different between the process cartridges 7 in the embodiment. FIG. 11 is a schematic view showing driving coupling configurations in the embodiment of the present invention.

In the process cartridges 7 for yellow (Y), magenta (M), and cyan (C), the driving portion for rotating and driving the photosensitive drums 1 and the driving portion for rotating and driving the developing rollers 4 are configured to have different driving sources. The driving portion for rotating and driving the photosensitive drums 1Y, 1M, and 1C are constituted by the driving motor 21, a gear train that transmits the rotation driving force of the driving motor 21, or the like. On the other hand, the driving portion for rotating and driving the developing rollers 4Y, 4M, and 4C are constituted by the driving motor 24, a gear train that transmits the rotation driving force of the driving motor 24, or the like. Note that the driving motor 24 also constitutes driving portion (second driving portion) for rotating and driving the rotation shafts of the transporting members 22Y, 22M, and 22C with another gear train.

In the process cartridge 7 for black (K), the driving portion for rotating and driving the photosensitive drum 1 and the driving portion for rotating and driving the developing roller 4 are constituted by a common driving motor 23. Moreover, the driving motor 23 constitutes the driving portion for rotating and driving the rotation shaft of the transporting member 22K with another gear train, and constitutes the driving portion for rotating and driving the roller 31*a* that circularly moves the intermediate transfer belt 31 with still another gear train. The above various driving motors and the gear trains correspond to the driving portion allowed to separately and variably rotate and drive the image bearing members, the developer bearing members, the supply rollers, and the transporting members in the present invention, and are controlled by the control portion 60.

(Supply of Toner by Urging Force Acting on Toner)

Figure 7:
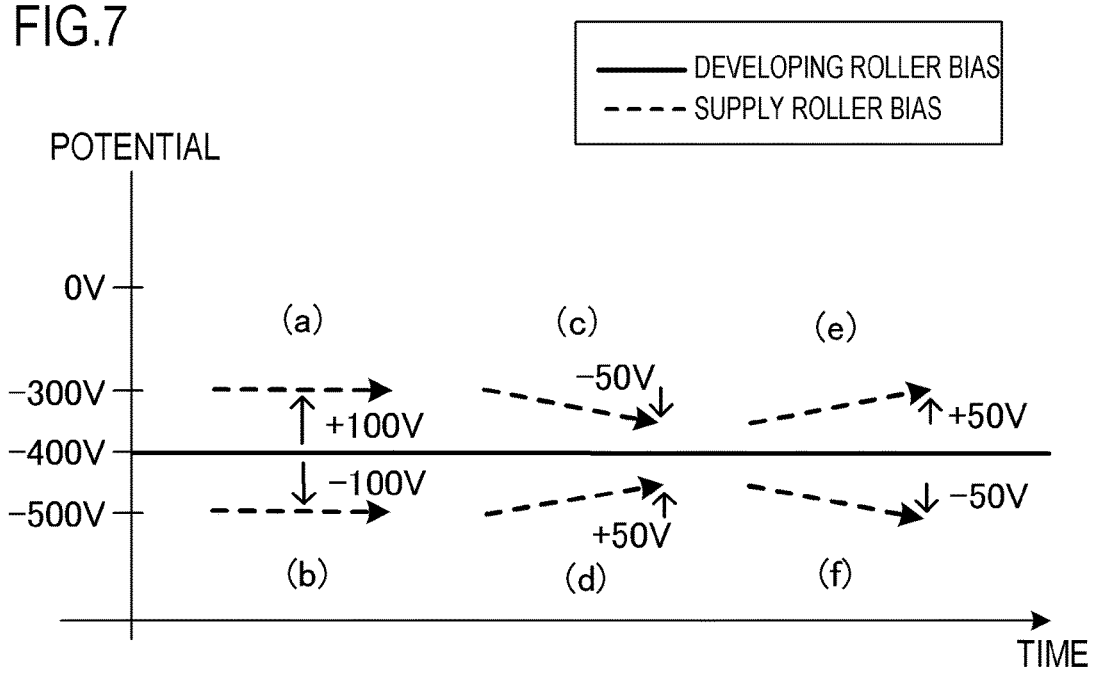
FIG. 7 is a schematic view for describing the relationship between the potential difference between biases and a toner urging force.

A description will be given, with reference to FIG. 7, of an urging force acting on the toner at the contact portion C2 between the supply roller 5 serving as a supply member and the developing roller 4 serving as a developer bearing member. FIG. 7 shows, with its vertical axis and horizontal axis defined as a potential and a time, respectively, the various patterns (a) to (f) of a supply roller bias and a developing roller bias that are to be changed. As described above, a force for urging the toner to any one of the side of the supply roller 5 and the side of the developing roller 4 acts on the toner at the contact portion C2 between the supply roller 5 and the developing roller 4 according to the sizes of biases applied to the supply roller 5 and the developing roller 4. Here, the supply of the toner from the supply roller 5 to the developing roller 4 is allowed when the force for urging the toner acts on the side of the developing roller 4.

(When Potential Difference between Biases is Constant)

The urging force acting on the toner for urging the toner to any one of the side of the supply roller 5 serving as a supply member and the side of the developing roller 4 serving as a developer bearing member is determined according to the polarity of a value obtained by subtracting the value of a bias applied to the developing roller 4 from the value of a bias applied to the supply roller 5. That is, the side to which the toner is urged is determined according to the polarity of the potential difference between a developing roller bias and a supply roller bias. When the polarity of the potential difference between the biases is the same as the regular charging polarity of the toner, the force for urging the toner from the side of the supply roller 5 to the side of the developing roller 4 acts on the toner at the contact portion C2 (pattern (b)). Conversely, when the polarity of the potential difference between the biases is opposite to the regular charging polarity of the toner, the force for urging the toner from the side of the developing roller 4 to the side of the supply roller 5 acts on the toner at the contact portion C2 (pattern (a)).

Specifically, as shown in the pattern (a) of FIG. 7, the potential difference between the biases is +100 V (i.e., (−300 V)−(−400 V)) and the polarity of the difference is positive when the developing roller bias is −400 V and the supply roller bias is −300 V. When the regular charging polarity of the toner is negative, the polarity of the potential difference between the biases is opposite to the regular charging polarity of the toner. Therefore, the force for urging the toner from the side of the developing roller 4 to the side of the supply roller 5 acts on the toner. Accordingly, in the pattern (a) of FIG. 7, the amount of the toner supplied to the developing roller 4 decreases compared with a case in which the potential difference between the biases is zero, and the amount of the toner to be coated also decreases.

On the other hand, as shown in the pattern (b) of FIG. 7, the potential difference between the biases is −100 V (i.e., (−500 V)−(−400 V)) and the polarity of the difference is negative when the developing roller bias is −400 V and the supply roller bias is −500 V. When the regular charging polarity of the toner is negative, the polarity of the potential difference between the biases is the same as the regular charging polarity of the toner. Therefore, the force for urging the toner from the side of the supply roller 5 to the side of the developing roller 4 acts on the toner. Accordingly, in the pattern (b) of FIG. 7, the amount of the toner supplied to the developing roller 4 increases compared with the case in which the potential difference between the biases is zero, and the amount of the toner to be coated also increases.

In addition, the greater the potential difference between the biases of the supply roller 5 serving as a supply member and the developing roller 4 serving as a developer bearing member, the greater the size of the urging force acting on the toner becomes. Both the force for urging the toner to the side of the supply roller 5 and the force for urging the toner to the side of the developing roller 4 act on the toner at the contact portion C2, and the potential difference between the biases represents a difference in the size between both the forces. That is, the polarity and the size of the potential difference between the biases of the supply roller 5 and the developing roller 4 determine which of the force for urging the toner to the side of the supply roller 5 and the force for urging the toner to the side of the developing roller 4 is more dominant as the force acting on the toner. Accordingly, when the potential difference is zero, the above two urging forces are matched. As a result, the urging force acting on the toner becomes zero.

(When Potential Difference between Biases Changes)

The above phenomenon occurs when the value of each of the applied biases is constant, i.e., when the potential difference between the biases is constant. On the other hand, when the potential difference between the biases changes with a change in the values of the biases (i.e., when the potential difference between the biases is changing), the side of the urging force acting on the toner changes according to how the potential difference between the biases changes.

For example, the following phenomenon occurs when the potential difference between the biases changes so as to gradually increase the force for urging the toner from the side of the supply roller 5 serving as a supply member to the side of the developing roller 4 serving as a developer bearing member. That is, for toner inside the supply roller 5, a force for retaining the toner inside the supply roller 5 is reduced while a force for supplying the toner to the developing roller 4 increases. Accordingly, out of the toner existing inside and on the front surface of the supply roller 5, toner having high response to the potential difference is first gradually supplied to the developing roller 4. That is, when the potential difference between the biases changes so as to reduce the size of the urging force whose urging direction is determined according to the polarity of the difference, the urging force in a direction opposite to the direction determined according to the polarity becomes dominant regardless of the polarity and the size of the potential difference between the biases at that point. As a result, a side to which the toner is to be urged is reversed (patterns (c) and (d)).

As shown in the pattern (c) of FIG. 7, when the supply roller bias changes from −300 V to −350 V in a prescribed time while the developing roller bias remains at the constant value −400 V, the potential difference between the biases changes from +100 V to +50 V. That is, the potential difference between the biases (the size of the applied bias) changes by −50 V with time, and the polarity of the change amount (inclination) per unit time becomes negative. When the regular charging polarity of the toner is negative, the potential difference between the biases changes so as to gradually reduce the size of the urging force for urging the toner from the side of the developing roller 4 to the side of the supply roller 5 with the positive polarity opposite to the polarity of the toner. Accordingly, as the force acting on the toner when the potential difference between the biases is changing, the urging force for urging the toner in a direction opposite to a direction determined by the positive polarity, i.e., the urging force for urging the toner from the side of the supply roller 5 to the side of the developing roller 4 with the negative polarity becomes dominant. As a result, the urging force in the direction according to the negative polarity acts on the toner, despite positive polarity of the potential difference between the biases.

Similarly, as shown in the pattern (d) of FIG. 7, when the supply roller bias changes from −500 V to −450 V in a prescribed time while the developing roller bias remains at the constant value −400 V, the potential difference between the biases changes from −100 V to −50 V. That is, the potential difference between the biases (the size of the applied bias) changes by +50 V with time, and the polarity of the change amount (inclination) per unit time becomes positive. When the regular charging polarity of the toner is negative, the potential difference between the biases changes so as to gradually reduce the size of the urging force for urging the toner from the side of the supply roller 5 to the side of the developing roller 4 with the negative polarity the same as the polarity of the toner. Accordingly, as the force acting on the toner when the potential difference between the biases is changing, the urging force for urging the toner in a direction opposite to a direction determined by the negative polarity, i.e., the urging force for urging the toner from the side of the developing roller 4 to the side of the supply roller 5 according to the positive polarity becomes dominant. As a result, the urging force in the direction according to the positive polarity acts on the toner, despite negative polarity of the potential difference between the biases.

On the other hand, when the potential difference between the biases changes so as to increase the size of the urging force whose urging direction is determined according to the polarity of the difference, the urging force becomes more dominant and a side on which the urging force acts on the toner does not change and remains the same (patterns (e) and (f)).

As shown in the pattern (e) of FIG. 7, when the supply roller bias changes from −350 V to −300 V in a prescribed time while the developing roller bias remains at the constant value −400 V, the potential difference between the biases changes from +50 V to +100 V. That is, the potential difference between the biases (the size of the applied bias) changes by +50 V with time, and the polarity of the change amount (inclination) per unit time becomes positive. When the regular charging polarity of the toner is negative, the potential difference between the biases changes so as to gradually increase the size of the urging force for urging the toner from the side of the developing roller 4 to the side of the supply roller 5 with the positive polarity opposite to the polarity of the toner. Accordingly, by the force acting on the toner when the potential difference between the biases is changing, the side to which the toner is biased according to the positive polarity is maintained. In addition, the urging force becomes more dominant.

Similarly, as shown in the pattern (f) of FIG. 7, when the supply roller bias changes from −450 V to −500 V in a prescribed time while the developing roller bias remains at the constant value −400 V, the potential difference between the biases changes from −50 V to −100 V. That is, the potential difference between the biases (the size of the applied bias) changes by −50 V with time, and the polarity of the change amount (inclination) per unit time becomes negative. When the regular charging polarity of the toner is negative, the potential difference between the biases changes so as to gradually increase the size of the urging force for urging the toner from the side of the supply roller 5 to the side of the developing roller 4 with the negative polarity the same as the polarity of the toner. Accordingly, by the force acting on the toner when the potential difference between the biases is changing, the side to which the toner is biased according to the negative polarity is maintained. In addition, the urging force becomes more dominant.

As described above, it is possible to supply the toner from the supply roller 5 serving as a supply member to the developing roller 4 serving as a developer bearing member when the potential difference between the biases is one at which the urging force for urging the toner acts on the side of the developing roller 4.

(Supply of Toner by Developer Transporting Member)

As a method for supplying the toner to the developing roller 4, it is possible to use the developer transporting member 22 besides the method according to the potential difference between the developing roller bias and the supply roller bias as described above. More specifically, the toner 10 accommodated in the developer accommodation chamber 18*b* is drawn up by the rotation force of the developer transporting member 22 and transported upward (transported to the upper side of) the contact portion C2 between the developing roller 4 serving as a developer bearing member and the supply roller 5 serving as a supply member. Subsequently, when the toner passes through the contact portion C2 between the developing roller 4 and the supply roller 5, some of the passing toner is supplied to the developing roller 4 by the pressure of the supply roller 5. Toner that has not been supplied to the developing roller 4 exits the lower side of the contact portion C2 between the developing roller 4 and the supply roller 5, and returns to the developer accommodation chamber 18*b* by the flow of the toner generated when the supply roller 5 rotates.

An increase in the amount of the toner supplied by the developer transporting member 22 is made possible by increasing the rotation speed of the developer transporting member 22 and transporting a greater amount of the toner to the upper side of the contact portion C2 between the developing roller 4 and the supply roller 5 per unit time. However, since the rubbing sound between the developer transporting member 22 and the inner wall of the developer accommodation chamber 18*b* deteriorates with an increase in the rotation speed, the amount of the toner supplied by the developer transporting member 22 is preferably minimized.

As described above, the method for supplying the toner to the developing roller 4 serving as a developer bearing member includes the two methods, i.e., the method using the potential difference between the developing roller bias and the supply roller bias and the method using the developer transporting member 22.

(High-Density Mode)

The embodiment provides special image forming operations such as the operation of increasing density or color gamut. Specifically, the embodiment provides two image forming operations including a "normal mode" in which density or color gamut is set to be normal as a first image forming operation and a "high-density mode" in which an increase in density or color gamut is allowed as a second image forming operation. However, the image forming operations are not limited to two image forming operations as in the embodiment but may include three or more image forming operations so long as the setting of density or color gamut is allowed in the operations. Here, it is assumed that the high-density mode is used only when density or color gamut is to be increased. This is because the use of the high-density mode results in an increase in a toner consumption amount even when the same image is output and accelerates the consumption of the toner.

In the normal mode of the embodiment, the peripheral velocity (the movement speed of the front surface) of the photosensitive drum 1 serving as an image bearing member is about 200 mm/sec, and the peripheral velocity of the developing roller 4 serving as a developer bearing member is about 300 mm/sec. That is, the peripheral velocity of the developing roller 4 with respect to the peripheral velocity of the photosensitive drum 1 is 150% (first peripheral velocity ratio). In addition, since the photosensitive drum 1 and the developing roller 4 rotate in the same direction at the contact portion C1 in the embodiment, the peripheral velocity ratio becomes a positive value. Therefore, when the photosensitive drum 1 and the developing roller 4 rotate in opposite directions (facing directions) at the contact portion C1, the peripheral velocity ratio becomes a negative value, i.e., −150%. Since the photosensitive drum 1 and the developing roller 4 rotate in the same direction at the contact portion C1 in the embodiment, the peripheral velocity ratio becomes the positive value. In the embodiment, the peripheral velocity ratio is calculated based on a contact portion at which the photosensitive drum 1 and the developing roller 4 contact each other. However, the peripheral velocity ratio may be calculated in other ways. For example, in the case of an apparatus configuration in which the photosensitive drum 1 and the developing roller 4 do not contact each other, it may be possible to set a position corresponding to the closest distance between the photosensitive drum 1 and the developing roller 4 as a facing portion and specify rotating directions based on the facing portion to calculate the peripheral velocity ratio. In the embodiment, the number of the rotations of each of the photosensitive drum 1 and the developing roller 4 is configured to be variable. In the high-density mode, the peripheral velocity ratio representing the ratio of the peripheral velocity of the developing roller 4 to the peripheral velocity of the photosensitive drum 1 is set to be higher compared with the normal mode. Specifically, in the first embodiment and second embodiment that will be described later, the peripheral velocity ratio of the developing roller 4 with respect to the photosensitive drum 1 is 150% in the normal mode (first image forming operation). However, in the high-density mode (second image forming operation), the peripheral velocity ratio is increased to 300% (second peripheral velocity ratio) by reducing the peripheral velocity of the photosensitive drum 1 by half while maintaining the peripheral velocity of the developing roller 4. In addition, in the high-density mode of the third embodiment, the peripheral velocity ratio is increased to 300% by doubling the peripheral velocity of the developing roller 4 (by doubling the number of the rotations of the driving motor). Since an increase in the amount of the toner mounted on the photosensitive drum 1 is allowed as described above, it is possible to increase density or color gamut. However, the peripheral velocity ratio may be increased in other ways. For example, the peripheral velocity ratio may be relatively increased by changing each of the peripheral velocities of the photosensitive drum 1 and the developing roller 4.

(Enlargement of Color Gamut)

Figure 8:
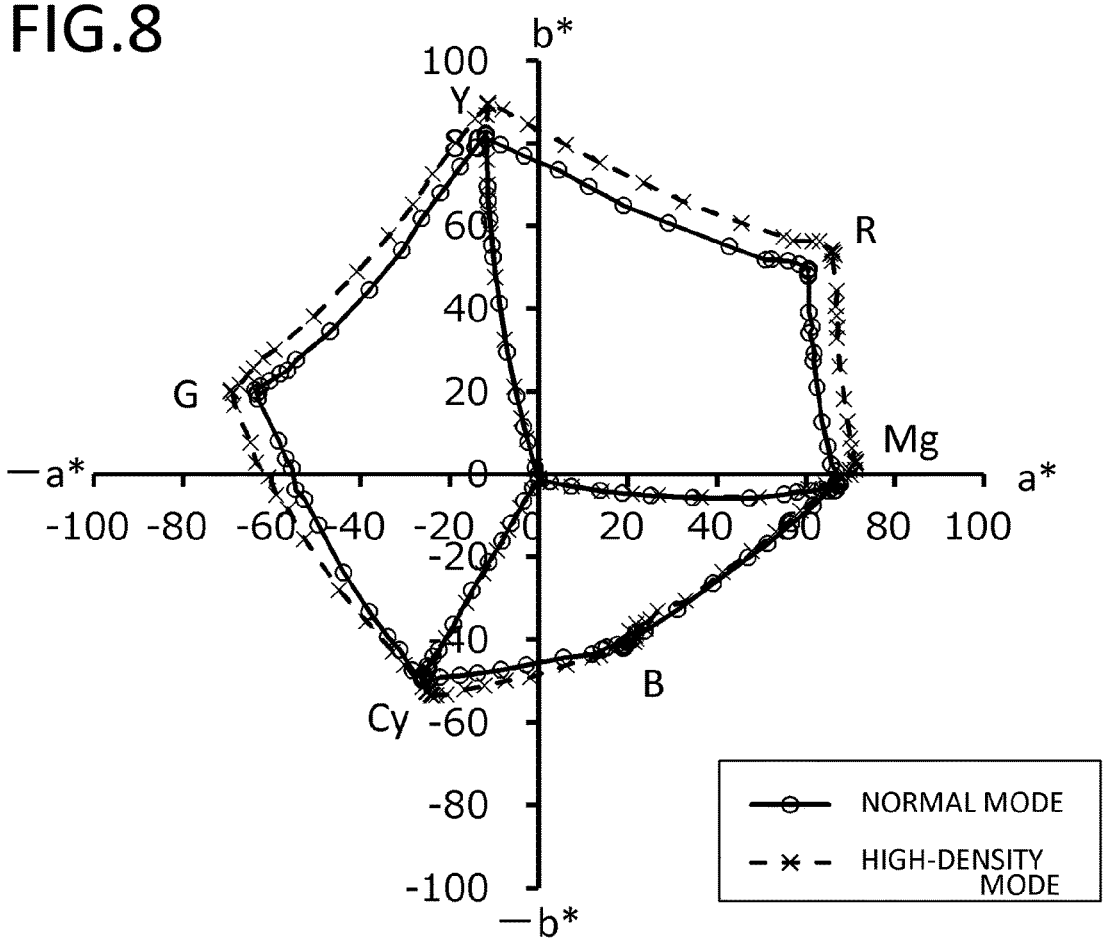
FIG. 8 is a chromaticity diagram in an embodiment of the present invention.

FIG. 8 is a chromaticity diagram showing the comparison between color gamut obtained when a color image is formed in the normal mode and color gamut obtained when the color image is formed in the high-density mode in the embodiment. In order to evaluate the color gamut, an L*a*b* color coordinate system (CIE) is used. In addition, in order to measure chromaticity, a Spectordensitometer 500 manufactured by X-Rite Inc. is used. FIG. 8 shows a change in the color gamut obtained when control in the high-density mode of the present invention that will be described later is similarly performed in each of the process cartridges for yellow (Y), magenta (Mg), and cyan (Cy) representing base colors in color image formation. It appears from FIG. 8 that, for example, the color gamut of red (R) formed by yellow (Y) and magenta (Mg) and the color gamut of green (G) formed by yellow (Y) and cyan (Cy) are enlarged when the normal mode is switched to the high-density mode. The enlargement of the color gamut of yellow (Y) and red (R) is allowed by 5% to 15%.

Note that the present invention is also applicable as the high-density mode to a case in which only the color gamut of a specific tinge is enlarged. For example, when only the color gamut of blue (B) formed by magenta (Mg) and cyan (Cy) is enlarged, the high-density mode of the present invention may be performed only in the process cartridges for magenta and cyan out of the four process cartridges. Thus, it is possible to more reliably achieve the enlargement of the color gamut of a specific tinge without causing the shortage of the amount of the supplied toner. In addition, for the adjustment of a tinge, the present invention is also applicable to a case in which the ratio of increasing the amount of the toner mounted per unit area is controlled to be different between the process cartridges. That is, in performing the high-density mode to set the ratio of the amount of the toner mounted per unit area between the process cartridges at a prescribed ratio, it is possible to more reliably achieve the above prescribed ratio without causing the shortage of the amount of the supplied toner according to the control of the present invention. Thus, it becomes possible to reliably perform the adjustment of a finer tinge.

(Image Failure Occurrence Mechanisms)

When the above high-density mode is used, there is a case that image missing (hereinafter called a "failure in solid followability") or an uneven density image occurs due to the shortage of the amount of the supplied toner. Such failures are likely to occur particularly when a high printing ratio image such as a totally solid image having a printing ratio of 100% is output. The mechanisms of such failures will be described. First, the failure in solid followability represents a phenomenon in which, when a high printing ratio image such as a totally solid image is output, a missing occurs in the image since the supply of the toner by the supply roller 5 and the developer transporting member 22 does not suffice for the amount of the toner used to output the image.

On the other hand, the uneven density image occurs when the toner retained inside the supply roller 5 is exhausted. More specifically, when the supply of the toner from the supply roller 5 to the developing roller 4 is continued to output a high printing ratio image such as a totally solid image, the supply of the toner to the supply roller 5 becomes insufficient, whereby the toner inside the supply roller 5 is exhausted. As described above, the supply roller 5 is an elastic sponge roller. Therefore, when entering the fine irregularities on the sponge front surface formed of the foaming body layer, the toner is allowed to be retained inside the foaming body layer as well. When the toner retained inside the foaming body layer becomes insufficient (exhausted), there is a case that an ability to supply the toner to the developing roller 4 deteriorates. If image formation is continued in such a state, the toner is likely to be unevenly supplied to the developing roller 4 even by slight outer diameter unevenness, rotating oscillation, or the like provided in the supply roller 5 as tolerance. The uneven supply of the toner results in the output of the uneven density image in the cycle of the supply roller 5.

In order to prevent the occurrence of such an uneven density image, it is necessary to set the developing roller bias and the supply roller bias at which the toner inside the supply roller 5 is not exhausted. Attention needs to be paid particularly when a greater amount of the toner is needed to output an image as in the high-density mode. In the embodiment, in the high-density mode, the peripheral velocity ratio of the developing roller 4 with respect to the photosensitive drum 1 is increased while the amount of the toner supplied from the developer transporting member 22 is increased. Meanwhile, the embodiment is characterized in that the potential difference between the developing roller 4 and the supply roller 5 is optimized to prevent the occurrence of an uneven density image or a failure in solid followability. Hereinafter, the details and the effect of the control will be described using the embodiment.

Figure 3:
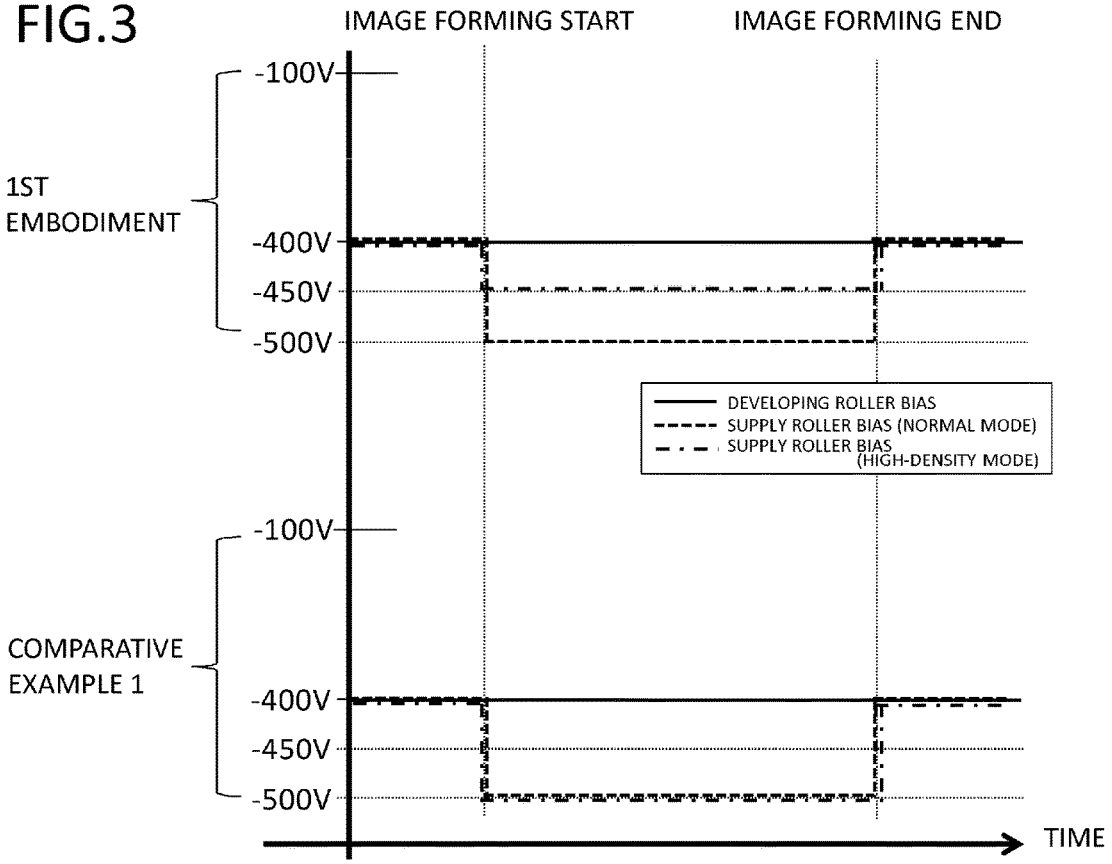
FIG. 3 is a timing chart of voltage control in the first embodiment of the present invention.

A description will be given, with reference to FIG. 3, of the bias control between the developing roller 4 and the supply roller 5 in the first embodiment of the present invention. FIG. 3 is a timing chart for describing a difference in the bias control between a case in which one print is output in the normal mode and a case in which the one print is output in the high-density mode in the embodiment, the embodiment being shown in comparison with comparative example 1.

Here, each timing in the timing chart will be described in detail. The following each timing represents a timing during the printing of one recording material (at an image forming operation). An "image forming start" timing represents a timing at which the writing of laser exposure in the sub-scanning direction starts. An "image forming end" timing represents a timing at which the laser exposure in the sub-scanning direction ends, and is shown for each of the normal mode and the high-density mode.

However, each of the above timings may be set in other ways so long as the laser exposure is completed during the printing (image forming operation) of the one recording material. For example, the "image forming start" timing may be set to be earlier by a prescribed time (prescribed period) than the timing at which the writing of the laser exposure in the sub-scanning direction starts. In addition, the "image forming end" timing may be set to be later by a prescribed time than, for example, the timing at which the laser exposure ends. The timings may be changed to be optimum according to the configurations of the developing apparatus and the image forming apparatus.

The bias applied to the developing roller 4 is constant from the "image forming start" to the "image forming end" in both the normal mode and the high-density mode, and a bias of −400 V is applied in the embodiment. The bias applied to the supply roller 5 is applied such that the potential difference between the bias applied to the supply roller 5 and the bias applied to the developing roller 4 generates a urging force for urging the toner from the supply roller 5 to the developing roller 4 from the "image forming start" up to the "image forming end". At this time, the value of the bias applied to the supply roller 5 during image formation is changed depending on whether an image is printed in the normal mode or the high-density mode. In the embodiment, the printing mode information acquisition portion 70 receives information having been input to the operation panel (not shown) of the image forming apparatus 100 before the "image forming start," and the value of the bias applied to the supply roller 5 is changed during the image formation based on the recording material information. In addition, the bias applied to the developing roller 4 is constant at a pre-rotation time representing the operation period of starting each apparatus configuration until the "image forming start" since the image forming operation of the apparatus starts, and a bias of −400 V is applied in the embodiment. Note that the developing roller bias is not necessarily controlled to be constant. Similarly, for the bias applied to the supply roller 5 as well, the potential difference between the developing roller 4 and the supply roller 5 is controlled to be constant at the pre-rotation time. In addition, the same bias control as the above is performed at a post-rotation time at which the operation of ending each apparatus configuration is performed after the image formation, a calibration period at which the adjustment of each apparatus configuration is performed, and a paper interval representing an interval until the start of the next image formation when the image formation is continuously performed on a plurality of recording materials.

When an image is printed in the normal mode, the bias applied from the "image forming start" to the "image forming end" is set at −500 V as a first supply bias. On the other hand, when the image is printed in the high-density mode, the bias applied from the "image forming start" to the "image forming end" is set at −450 V as a second supply bias. Accordingly, the potential difference between the developing roller bias and the supply roller bias in a case in which the image is printed in the high-density mode is made smaller compared with a case in which the image is printed in the normal mode.

In addition, in the high-density mode, the peripheral velocity (the number of the rotations) of the photosensitive drum 1 is reduced by half to increase the peripheral velocity ratio of the developing roller 4 with respect to the photosensitive drum 1 to 300% as described above. In addition, since the developing roller 4 and the developer transporting member 22 are driven by the common driving motor source, a rotation number ratio representing the ratio of the number of the rotations of the developer transporting member 22 to the number of the rotations of the photosensitive drum 1 is doubled. Further, by setting the peripheral velocity ratio of the developing roller 4 at 300% and setting the rotation number ratio of the developer transporting member 22 with respect to the photosensitive drum 1 to be doubled, it is possible to output the maximum density or more for the high-density mode. That is, the peripheral velocity ratio is set so as to have a margin of the amount of the supplied toner even when the maximum density is output in the high-density mode. By the above control, it is possible to provide a high-quality image while reducing the occurrence of an uneven density image or a failure in solid followability even when the amount of the toner necessary for image formation is increased in the high-density mode.

(Experiment 1)

Here, an experiment conducted to show the effect of the embodiment will be described. In the experiment, an evaluation image was printed in both the normal mode and the high-density mode under ordinary temperature and ordinary humidity conditions (temperature: 23° C., humidity: 50%) to evaluate an uneven density image. For the evaluation of the uneven density image, three A4 prints of a totally solid image were successively output, and the uneven density image was determined from the totally solid image on the third print. A printing test and the evaluation image were output in one color. When there was uneven density between the output images, the following evaluation was conducted using Spectordensitometer 500 manufactured by X-Rite Inc. based on the density difference between the output images.

A rank: density difference of uneven image is less than 0.2 in totally solid image B rank: density difference of uneven image is 0.2 to less than 0.3 in totally solid image C rank: density difference of uneven image is 0.3 or more in totally solid image Here, it is assumed that the B rank is an allowable level as a target image rank. The density difference at the B rank is hardly conspicuous on an image. In addition, the amount of the toner (hereinafter called M/S (mg/cm$^2$)) per unit area on the photosensitive drum 1 during the printing of the totally solid image was measured. As a measurement position, the first half of the totally solid image on the first print was measured. In addition, as an example of comparing the effect of the first embodiment, the same experiment was conducted for the case of the bias control of comparative example 1 shown in FIG. 3 to evaluate the uneven density image. In comparative example 1, the value of the supply roller bias in the normal mode and the value of the supply roller bias in the high-density mode are set to be constant from the "image forming start" to "image forming end." The results of the experiment are shown in Table 1.

TABLE 1

| | Normal mode | | | High-density mode | | |
|---|---|---|---|---|---|---|
| | Supply roller bias | Uneven density image | M/S on drum during printing of totally solid image | Supply roller bias | Uneven density image | M/S on drum during printing of totally solid image |
| 1st embodiment | −500 V | A | 0.4 | −450 V | B | 0.7 |
| Comparative example 1 | −500 V | A | 0.4 | −500 V | C | 0.8 |

In the normal mode, the occurrence of the uneven density image was not confirmed with the potential difference between the biases in the first embodiment and the potential difference between the biases in comparative example 1. On the other hand, in the high-density mode, the occurrence of the uneven density image was improved from the rank C in comparative example 1 to the rank B when the control of the first embodiment was performed. This is because an increase in the amount of the toner supplied to the contact portion C2 between the developing roller 4 and the supply roller 5 was made possible by increasing the number of the rotations of the developer transporting member 22 with respect to the photosensitive drum 1. Besides, since the exhaustion of the toner inside the supply roller 5 was prevented by changing the supply roller bias, the occurrence of the uneven density image was improved.

On the other hand, in comparative example 1, the toner was positively supplied from the supply roller 5 to the developing roller 4 by the supply roller bias. Therefore, although the M/S on the photosensitive drum 1 was temporarily increased, the level of the uneven density image was poor due to the exhaustion of the toner inside the supply roller 5.

As described above, in the high-density mode, the peripheral velocity ratio of the developing roller 4 and the number of the rotations of the developer transporting member 22 with respect to the photosensitive drum 1 are increased based on a control signal from the control portion. In addition, the value of the supply roller bias with respect to the value of the developing roller bias is changed to a greater extent on the side opposite to the regular charging polarity of the toner compared with the normal mode. That is, when the speed difference between the rotation bodies is reliably increased, the urging force acting on the toner with the potential difference is reduced (braked) while a physical toner transporting force is increased. Thus, the toner is prevented from being excessively transported and the toner inside the supply roller 5 is prevented from being exhausted. As a result, even if the amount of the toner entering the contact portion C2 between the developing roller 4 and the supply roller 5 fluctuates, it is possible to prevent the occurrence of the uneven density image since the toner inside the supply roller 5 is adjusted. That is, the first image forming operation of the present invention corresponding to the normal mode represents an image forming operation in which the image bearing member and the developer bearing member are rotated and driven at a first peripheral velocity ratio to perform a normal image forming operation. In addition, the second image forming operation of the present invention corresponding to the high-density mode represents an image forming operation in which the image bearing member and the developer bearing member are rotated and driven at a second peripheral velocity ratio greater than the first peripheral velocity ratio. Moreover, in the second image forming operation, the potential difference between the developing bias and the supply bias becomes a potential difference at which a urging force for moving the developer at the contact portion between the developer bearing member and the supply member from the supply member to the developer bearing member becomes smaller compared with the first image forming operation. Alternatively, in the second image forming operation, the potential difference between the developing bias and the supply bias becomes a potential difference at which a urging force for moving the developer at the contact portion between the developer bearing member and the supply member from the developer bearing member to the supply member is generated.

Note that although the first embodiment and comparative example 1 describe the case in which the bias applied to the supply roller 5 is controlled, it may be possible to have a configuration in which the bias applied to the developing roller 4 is controlled to control the potential difference between the developing roller 4 and the supply roller 5. In addition, the occurrence of an uneven density image as in this case is influenced by the size of a recording material on which an image is printed. Therefore, when an image is printed on a longer paper, the toner to form the image is needed for a long period of time, which further increases the likelihood of the occurrence of an uneven density image. Accordingly, when control as in the high-density mode of the embodiment is performed to print an image on a long paper, it is possible to prevent the occurrence of an uneven density image.

In addition, the embodiment describes the case in which the value of the supply roller bias is controlled to be constant during image formation. However, the value of the supply roller bias may have other values. For example, the supply roller bias may be inclined to gradually change within the scope of the present invention. Specific examples will be described with reference to FIGS. 9 and 10.

Figure 9:
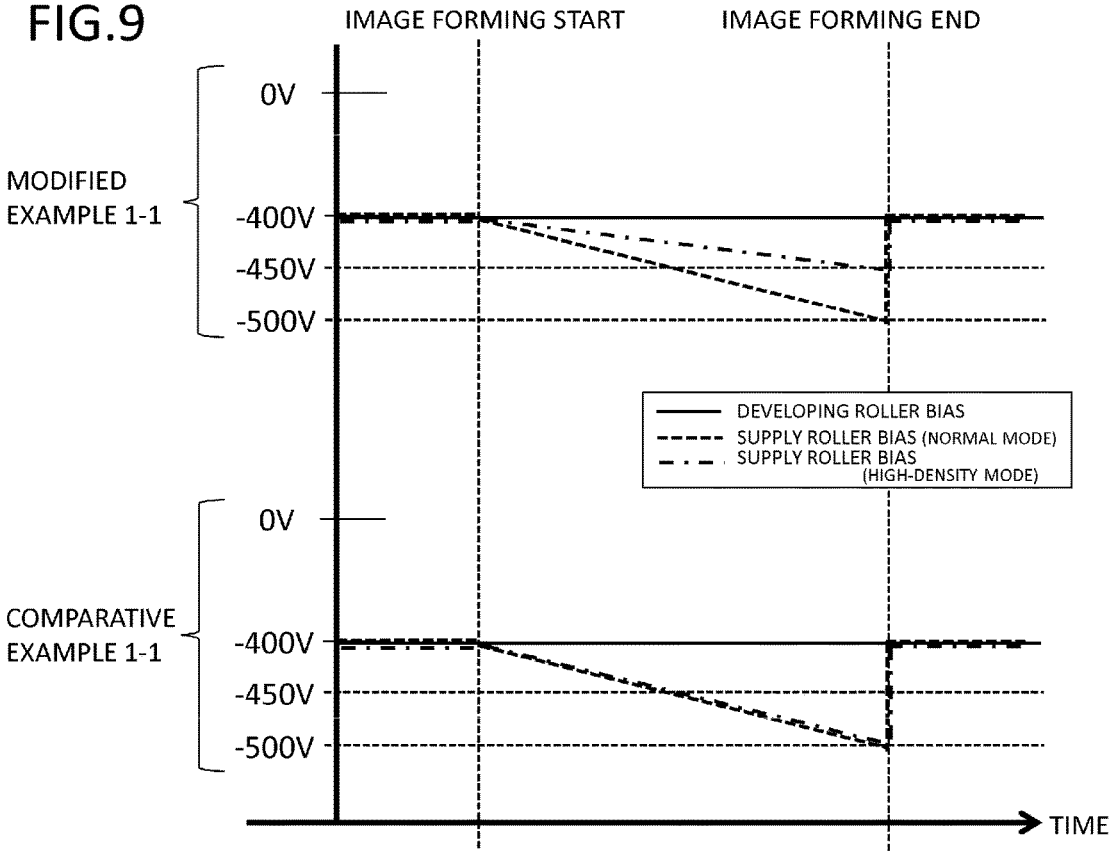
FIG. 9 is a timing chart of voltage control in a modified example of the present invention.

FIG. 9 is a timing chart for describing a difference in the bias control between a case in which one print is output in the normal mode and a case in which the one print is output in the high-density mode in modified example 1-1 of the embodiment, the modified example 1-1 being shown in comparison with comparative example 1-1. The bias control in modified example 1-1 represents control in which the bias applied to the supply roller 5 is inclined to gradually increase the potential difference so as to urge the toner from the supply roller 5 to the developing roller 4 in a period from the "image forming start" to the "image forming end." Thus, the toner having high response to the potential difference between the developing roller 4 and the supply roller 5 is first gradually supplied from the supply roller 5 to the developing roller 4. In the high-density mode, the bias control to incline the applied bias is performed such that the inclination of the bias (a change amount per unit time) is made smaller compared with the normal mode. That is, the inclination of the bias is changed such that the polarity (polarity of a change in change amount per unit time) of the difference between the inclination of the supply bias in the normal mode and the inclination of the supply bias in the high-density mode becomes opposite to the regular charging polarity of the toner. Thus, in modified example 1-1, the urging force for urging the toner from the supply roller 5 to the developing roller 4 is made smaller in the high-density mode compared with the normal mode. On the other hand, in comparative example 1-1, control is performed in which the inclination of the applied bias is not changed between the normal mode and the high-density mode. According to modified example 1-1, it is possible to further prevent the exhaustion of the toner inside the supply roller 5 and the occurrence of the uneven density image compared with comparative example 1-1.

Figure 10:
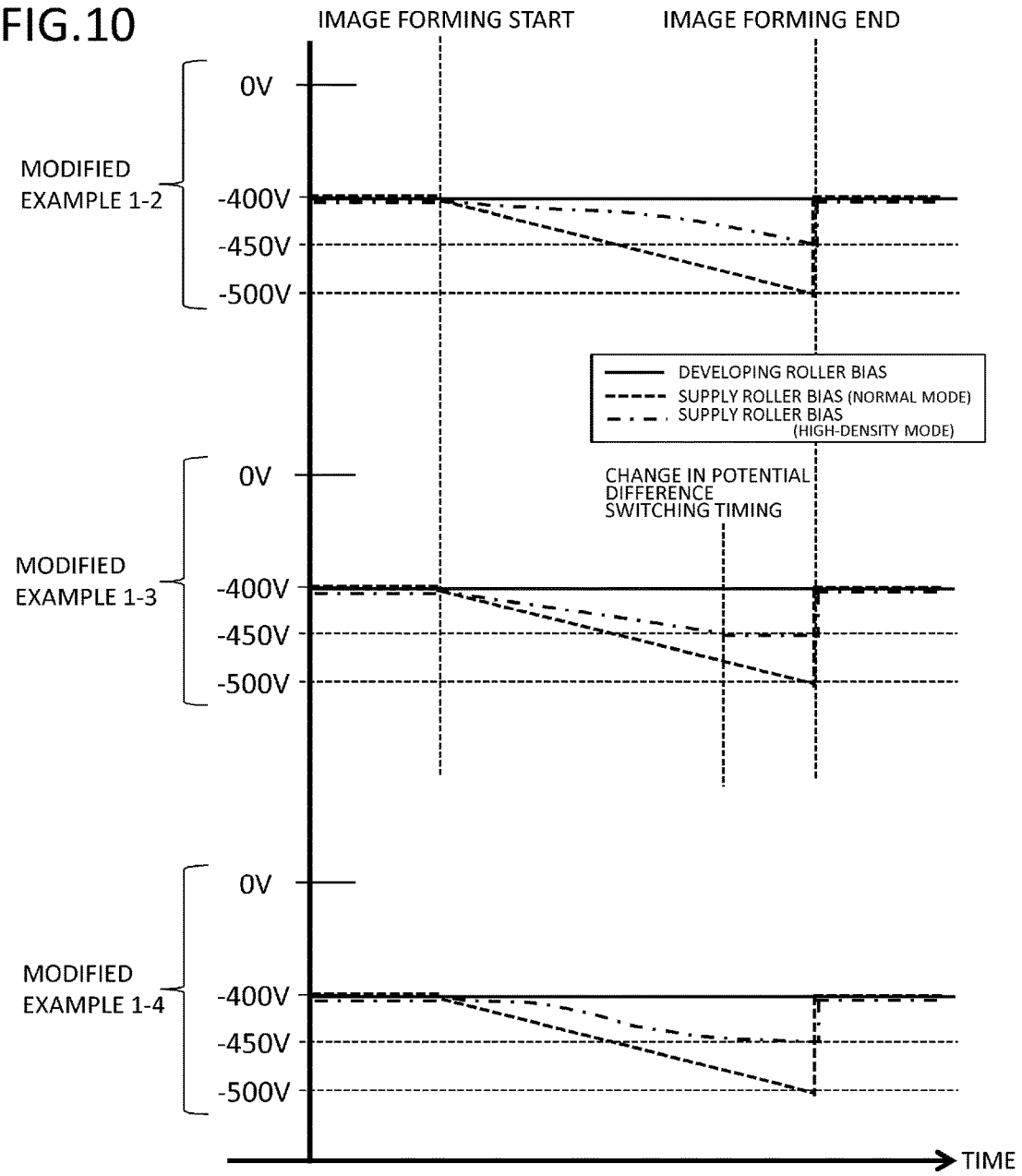
FIG. 10 is a timing chart of voltage control in modified example of the present invention.

FIG. 10 is a timing chart for describing a difference in the bias control between a case in which one print is output in the normal mode and a case in which the one print is output in the high-density mode in modified examples 1-2 to 1-4 of the embodiment. Modified example 1-1 in FIG. 9 represents a control example in which the bias applied to the supply roller 5 during image formation is changed in a constant amount (with a constant inclination) per unit time, but the inclination of the applied bias may be changed in various ways. Modified example 1-2 in FIG. 10 represents a control example in which the bias applied in the high-density mode is changed such that the inclination of the applied bias gradually increases. Modified example 1-3 in FIG. 10 represents a control example in which a change in the difference between the potentials is switched at a prescribed timing in the period between the image forming start and the image forming end. A bias having a prescribed inclination is applied until the timing, and thereafter a constant bias is applied. Modified example 1-4 in FIG. 10 represents a control example in a case in which the inclination of the applied bias is continuously changed (in stages) such that a change in the bias draws a sine curve. Note that the above control examples are only for description purposes and other control patterns may be used.

Note that the above control in which the peripheral velocity ratio and the bias are changed according to the normal mode and the high-density mode may be performed only under prescribed conditions. For example, the above control may be performed only when an image having a high printing ratio is formed. That is, even if the above control is performed in an image forming operation (for example, the printing of documents for business or the like) in which uneven density hardly occurs or does not cause a problem, there is a difficulty in obtaining an effect corresponding to the consumption of toner. Such a waste consumption of toner is preferably avoided. Here, the printing ratio is defined as the ratio of the area of an image formed in a prescribed region to the area of the prescribed region representing a part of a printable region (image forming allowing region) of the recording material 12. For example, the printing ratio becomes 100% in the case of a whole-area solid black image in which an image is formed in the whole area of the prescribed region of the recording material 12, and becomes 0% in the case of a solid white image in which no image is formed. As printing ratio acquisition portion, the control portion 60 acquires a printing ratio from image data. The above control, i.e., the high-density mode may be configured to be selectable and executable when the printing ratio is a prescribed threshold or more (that may be set at, for example, 50% or more but is appropriately set according to whether uneven density causes a problem).

(Second Embodiment)

As described above, the occurrence of the uneven density image is improved to the B rank in the first embodiment. On the other hand, in the second embodiment, the value of the supply roller bias in the high-density mode is directed to the positive side to a greater extent compared with the first embodiment and set to have a smaller absolute value than that of the value of the developing roller bias to prevent the occurrence of the uneven density image. In the second embodiment, the value of the supply roller bias is set to have a smaller absolute value than that of the value of the developing roller bias and have a potential difference on the side opposite to that of the toner charging polarity. Therefore, the urging force for urging the toner acts from the developing roller 4 to the supply roller 5. Thus, since the toner inside the supply roller 5 is not entirely used to be supplied to the developing roller 4, the exhaustion itself of the toner inside the supply roller 5 does not occur.

Figure 4:
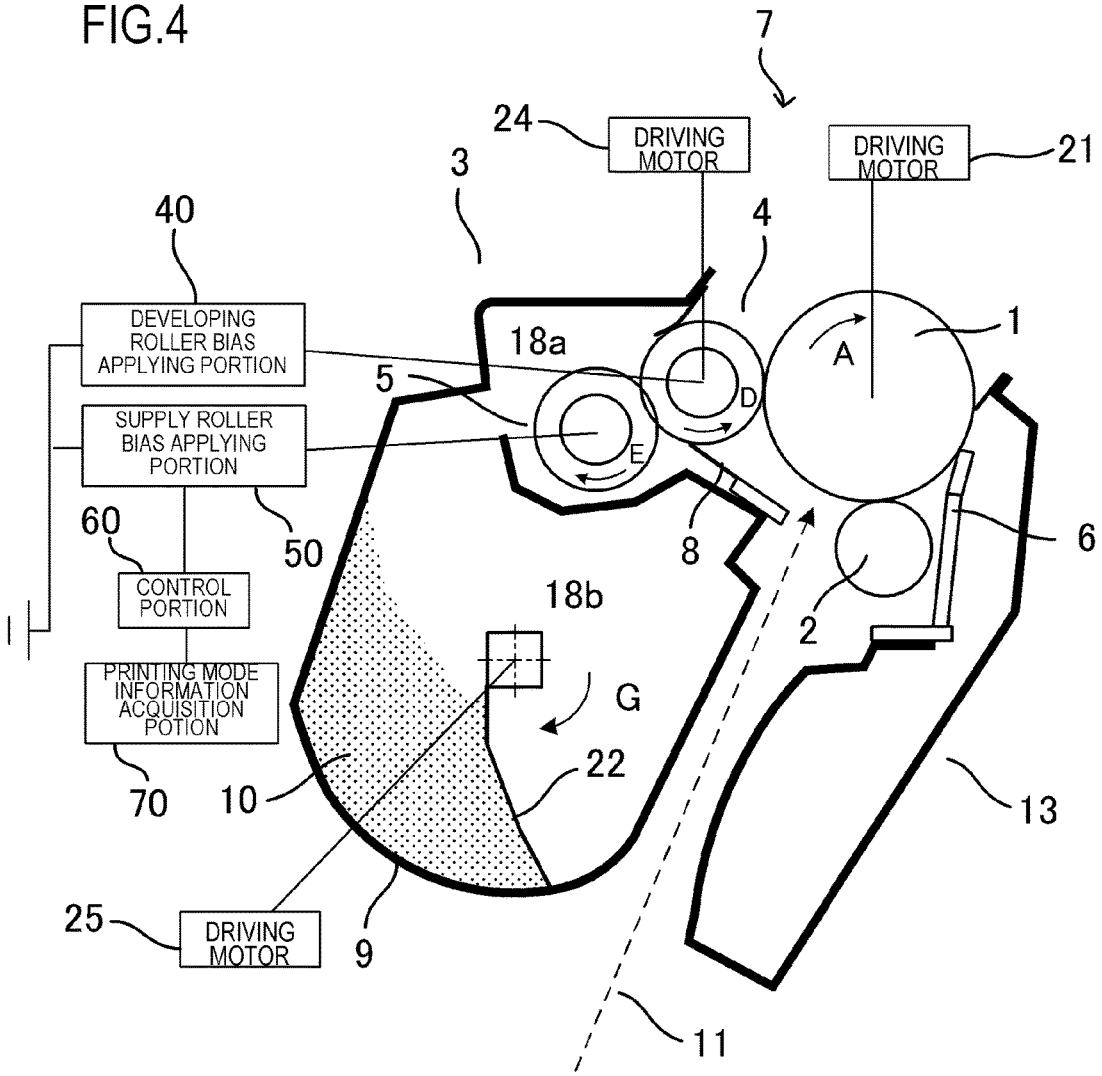
FIG. 4 is a schematic cross-sectional view of a process cartridge in a second embodiment of the present invention.

FIG. 4 is a cross-sectional (main cross-sectional) view schematically showing a cross section perpendicular to the longitudinal direction (rotational axis direction) of the photosensitive drum 1 of each of the process cartridges 7 for yellow (Y), magenta (M), and cyan (C) in the second embodiment. In the second embodiment, the amount of the toner supplied to the developing chamber **18*a* by the developer transporting member 22 is greater than that of the first embodiment. Specifically, in the embodiment, the developer transporting member 22 is configured to be driven by a driving motor 25 different from the developing roller 4 in each of the process cartridges 7 for yellow (Y), magenta (M), and cyan (C). Then, in a state in which the number of the rotations of the developing roller 4 remains constant, only the number of the rotations of the developer transporting member 22** is doubled to increase the amount of the supplied toner. Since configurations other than the above configurations are the same as those of the first embodiment, their duplicated descriptions will be omitted. Hereinafter, the configuration of the second embodiment will be described specifically.

Figure 5:
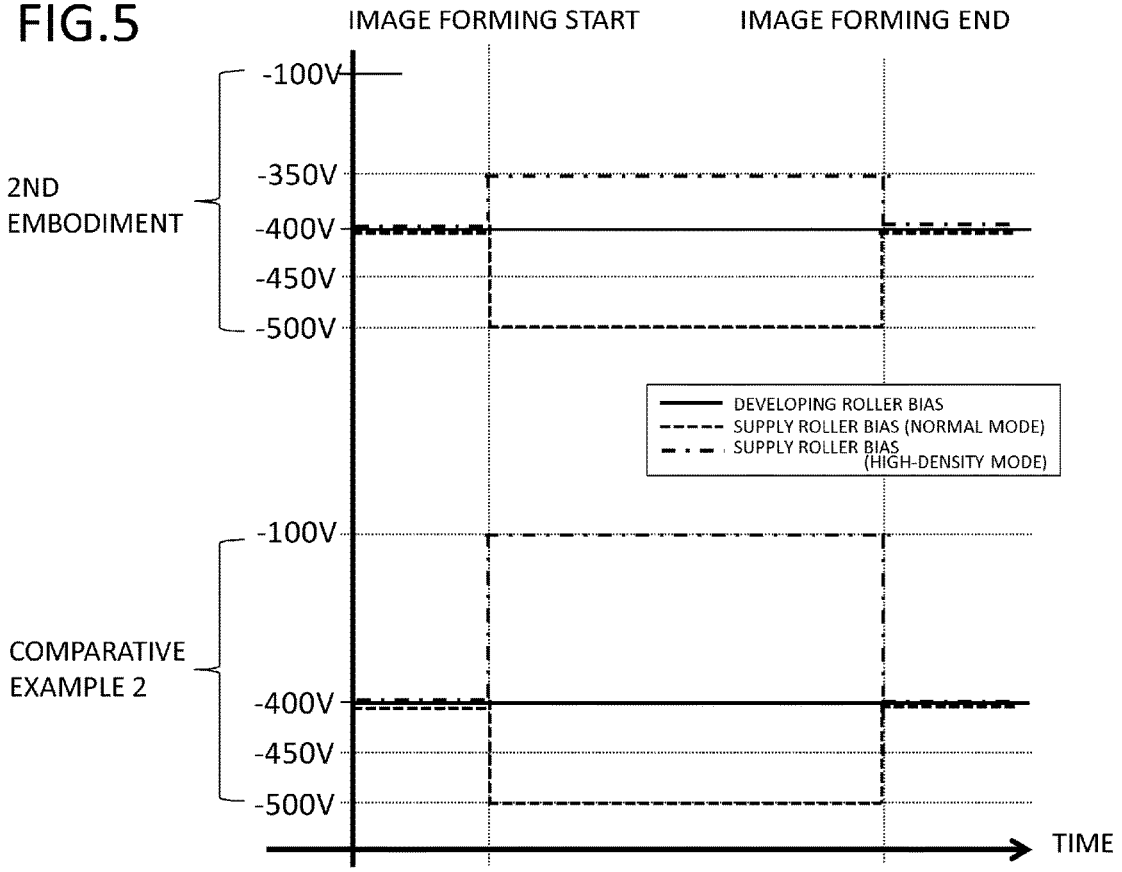
FIG. 5 is a timing chart of voltage control in the second embodiment of the present invention.

FIG. 5 is a timing chart for describing a difference in the bias control between a case in which one print is output in the normal mode and a case in which the one print is output in the high-density mode in the second embodiment, the second embodiment being shown in comparison with comparative example 2. The bias applied to the developing roller 4 is constant from the "image forming start" to the "image forming end" in both the normal mode and the high-density mode similarly to the first embodiment, and a bias of −400 V is applied in the embodiment. Unlike the first embodiment, the bias applied to the supply roller 5 is applied so as to have a potential difference at which a urging force for moving the toner from the developing roller 4 to the supply roller 5 is generated from the "image forming start" to the "image forming end."

When an image is printed in the normal mode, the bias applied from the "image forming start" to the "image forming end" is set at −500 V. On the other hand, when the image is printed in the high-density mode, the bias applied from the "image forming start" to the "image forming end" is set at −350 V. In addition, in the high-density mode, the peripheral velocity of the photosensitive drum 1 is reduced by half (the number of the rotations is halved) to increase the peripheral velocity ratio of the developing roller 4 with respect to the photosensitive drum 1 to 300% similarly to the first embodiment. In addition, the developer transporting member 22 has an independent driving motor source, and the number of the rotations of the driving motor source is doubled to increase the amount of the toner supplied to the contact portion C2 between the developing roller 4 and the supply roller 5. That is, compared with the normal mode, the number of the rotations of the photosensitive drum 1 is reduced by half, the number of the rotations of the developing roller 4 is made the same, and the number of the rotations of the developer transporting member 22 is doubled in the high-density mode to increase the amount of the supplied toner. By the above control, it is possible to provide a high-quality image without the occurrence of the uneven density image or the failure in solid followability even when the amount of the toner necessary for image formation is increased in the high-density mode.

(Experiment 2)

Here, an experiment conducted to show the effect of the embodiment will be described. In the experiment, an evaluation image was printed in both the normal mode and the high-density mode under ordinary temperature and ordinary humidity conditions (temperature: 23° C., humidity: 50%) to evaluate the uneven density image and the failure in solid followability. Since a method for evaluating the uneven density image is the same as that of Experiment 1, its description will be omitted. For the evaluation of the failure in solid followability, three A4 prints of a totally solid image were successively output like the case of the uneven density image, and the failure in solid followability was determined from the totally solid image on the third print. The following evaluation was conducted using Spectordensitometer 500 manufactured by X-Rite Inc. based on the density difference between the front end and the rear end of the output.

A rank: density difference between front end and rear end of sheet is less than 0.2 in totally solid image B rank: density difference between front end and rear end of sheet is 0.2 to less than 0.3 in totally solid image C rank: density difference between front end and rear end of sheet is 0.3 or more in totally solid image In addition, as an example of comparing the effect of the second embodiment, the same experiment was conducted for the case of the bias control of comparative example 1 shown in FIG. 3 and the case of the bias control of comparative example 2 shown in FIG. 5 to evaluate the uneven density image and the failure in solid followability. Since the bias control of comparative example 1 is the same as that of Experiment 1, its description will be omitted. In comparative example 2, the value of the supply roller bias was increased to −100 V from the "image forming start" to the "image forming end" in the high-density mode. The results of the experiment are shown in Table 2.

TABLE 2

| | Normal mode | | | High-density mode | | |
|---|---|---|---|---|---|---|
| | Supply roller bias | Uneven density image | Failure in solid followability | Supply roller bias | Uneven density image | Failure in solid followability |
| 2nd embodiment | −500 V | A | A | −350 V | A | A |
| Comparative example 1 | −500 V | A | A | −500 V | C | A |
| Comparative example 2 | −500 V | A | A | −100 V | A | B |

In the normal mode, the occurrence of both the uneven density image and the failure in solid followability was not confirmed with the potential difference between the biases in the second embodiment and the potential difference between the biases in comparative example 2. On the other hand, in the high-density mode, the occurrence of the uneven density image was further improved compared with the first embodiment from the rank C in comparative example 1 to the rank A when the control of the second embodiment was performed. In addition, in the second embodiment, the occurrence of the failure in solid followability was not confirmed although the potential difference between the developing roller bias and the supply roller bias in the high-density mode was set at +50 V to cause the urging force to act from the developing roller 4 to the supply roller 5. This is because the amount of the supplied toner was increased by doubling the number of the rotations of the developer transporting member 22. On the other hand, as shown in comparative example 2, when the potential difference between the developing roller bias and the supply roller bias in the high-density mode was increased to +300 V, the failure in solid followability occurred at the B rank although the uneven density image was improved to the A rank. This is because the urging force for urging the toner from the developing roller 4 to the supply roller 5 was excessive and thus only the supply of the toner from the developer transporting member 22 did not suffice for the amount of the toner necessary for image formation.

As described above, in the embodiment, the value of the supply roller bias is controlled to be changed to the side opposite to the toner charging polarity compared with the normal mode, and the potential difference between the supply roller bias and the developing roller bias is controlled to have the polarity opposite to the toner charging polarity. Thus, similarly to the first embodiment, it is possible to prevent the occurrence of the uneven density image. Since the supply roller bias has the potential difference on the side opposite to that of the toner charging polarity, the urging force for urging the toner from the developing roller 4 to the supply roller 5 acts on the toner. Thus, since the toner inside the supply roller 5 is not entirely used to be supplied to the developing roller 4, it is possible to prevent the exhaustion of the toner inside the supply roller 5.

In addition, the uneven density image and the failure in solid followability as described in the embodiment are likely to occur in high printing images. In the case of a low printing ratio at which only a part of an image is printed even with high density, the toner inside the supply roller 5 is not exhausted since the use amount itself of the toner is small. In consideration of such a situation, the control portion 60 may detect the printing ratio of an output image from image information and perform the control of the embodiment when a printing ratio is higher than a prescribed threshold. Thus, it is possible to perform control to prevent the occurrence of the uneven density image or the failure in solid followability at an appropriate timing. Thus, since the number of the rotations of the developer transporting member 22 needs only to be increased according to a printing ratio where necessary, it is possible to prevent the occurrence of a situation, in which the rubbing sound between the developer transporting member 22 and the interior wall of the developer accommodation chamber 18*b* deteriorates, to the greatest possible extent.

(Third Embodiment)

The third embodiment of the present invention is characterized in that in the high-density mode, the peripheral velocity of the photosensitive drum 1 is not reduced but the peripheral velocity (the number of the rotations) of the developing roller 4 is doubled to increase the peripheral velocity ratio of the developing roller with respect to the photosensitive drum 1 to 300%. In addition, in the third embodiment, the developing roller 4 and the developer transporting member 22 are driven by the same driving motor, and the number of the rotations of the developer transporting member 22 is also doubled in the high-density mode. By the above configurations, it is possible to further increase the amount of the supplied toner per unit time due to the following reason compared with the first embodiment. Accordingly, it is possible to cause a change in the supply roller bias in the high-density mode with respect to the supply roller bias in the normal mode to be directed to the positive side to a greater extent compared with the first embodiment. By the above control, it is possible to further prevent the occurrence of the uneven density image compared with the first embodiment. Hereinafter, the configurations of the third embodiment will be described specifically. Since configurations other than the above configurations are the same as those of the first embodiment, their descriptions will be omitted.

Figure 6:
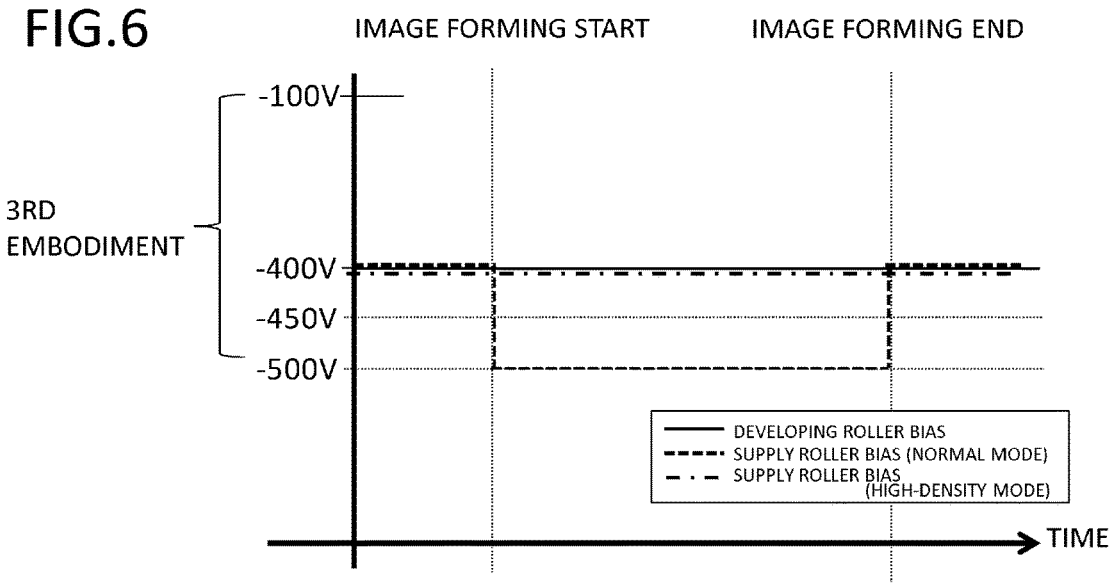
FIG. 6 is a timing chart of voltage control in the third embodiment of the present invention.

FIG. 6 is a timing chart for describing a difference in the bias control between a case in which one print is output in the normal mode and a case in which the one print is output in the high-density mode in the third embodiment. The bias applied to the developing roller 4 is constant from the "image forming start" to the "image forming end" in both the normal mode and the high-density mode similarly to the first embodiment, and a bias of −400 V is applied in the embodiment. The bias applied to the supply roller 5 is set at −500 V from the "image forming start" to the "image forming end" in the normal mode. On the other hand, in the high-density mode, the bias applied to the supply roller 5 from the "image forming start" to the "image forming end" is set at −400 V the same as the developing bias.

In addition, the peripheral velocity of the developing roller 4 is doubled (the number of the rotations is doubled) to increase the peripheral velocity ratio of the developing roller 4 with respect to the photosensitive drum 1 in the high-density mode to 300%. Moreover, the developing roller 4 and the developer transporting member 22 are driven by the same driving motor. Therefore, when the number of the rotations of the developing roller 4 is doubled, the number of the rotations of the developer transporting member 22 is also doubled, which results in an increase in the amount of the supplied toner per unit time. However, in the third embodiment, the amount of the supplied toner per unit time is increased to twice or more and specifically increased up to 2.2 times. When the number of the rotations of the developer transporting member 22 is doubled, a time in which the toner is drawn up by the developer transporting member 22 is reduced by half. Accordingly, the amount of the toner spilled over into the developer accommodation chamber 18*b* from the developer transporting member 22 decreases when the toner is being drawn up. As a result, a greater amount of the toner is obtained compared with an amount obtained by simply doubling the amount of the supplied toner at a one-time rotation number. In addition, an increase in the peripheral velocity (the number of the rotations) of the developing roller 4 only in the high-density mode aims to prevent the occurrence of a situation, in which the rubbing sound between the developer transporting member 22 and the inner wall of the developer accommodation chamber 18*b* deteriorates, to the greatest possible extent. By the above control, it is possible to provide a high-quality image without the occurrence of the uneven density image or the failure in solid followability even when the amount of the toner necessary for image formation is increased in the high-density mode.

Experiment 3)

Here, an experiment conducted to show the effect of the embodiment will be described. In the experiment, an evaluation image was printed in both the normal mode and the high-density mode under ordinary temperature and ordinary humidity conditions (temperature: 23° C., humidity: 50%) to evaluate the uneven density image and the failure in solid followability. Since a method for evaluating the uneven density image and the failure in solid followability is the same as that of Experiment 1, its description will be omitted. In addition, as an example of comparing the effect of the third embodiment, comparative example 1 shown in FIG. 3 was used. The bias control of comparative example 1 is the same as that of Experiment 1, its duplicated description will be omitted.

TABLE 3

| | Normal mode | | | High-density mode | | |
|---|---|---|---|---|---|---|
| | Supply roller bias | Uneven density image | Failure in solid followability | Supply roller bias | Uneven density image | Failure in solid followability |
| 3rd embodiment | −500 V | A | A | −400 V | A | A |
| Comparative example 1 | −500 V | A | A | −500 V | C | A |

In the normal mode, the occurrence of both the uneven density image and the failure in solid followability was not confirmed with the potential difference between the biases in the third embodiment and the potential difference between the biases in comparative example 1. On the other hand, in the high-density mode, the occurrence of the uneven density image was further improved compared with the first embodiment from the rank C in comparative example 1 to the rank A when the control of the third embodiment was performed. In addition, in the third embodiment, the occurrence of the failure in solid followability was not confirmed although the potential difference between the developing roller bias and the supply roller bias in the high-density mode was set at 0 V to prevent the urging force for urging the toner from acting on both the developing roller 4 and the supply roller 5. This is because the amount of the supplied toner was increased to 2.2 times as the number of the rotations of the developer transporting member 22 was doubled.

As described above, it is possible to further increase the amount of the supplied toner with an increase in the number of the rotations of the developing roller 4 and the developer transporting member 22 in the high-density mode and cause the supply roller bias to be directed to the positive side to a greater extent. Thus, it is possible to further prevent the occurrence of the uneven density image.

(Other)

The above embodiments describe the configuration in which the process cartridge where the photosensitive drum serving as an image bearing member and processing portion acting on the image bearing member are integrated with each other is attachable/detachable to/from the apparatus main body. However, other configurations may be used.

It may be possible to use a configuration in which the developing unit constituting the process cartridge is separately attachable/detachable to/from the apparatus main body. Similarly, it may be possible to use a configuration in which the photosensitive member unit is separately attachable/detachable to/from the apparatus main body.

Moreover, it may be possible to use a configuration in which the developing unit and the photosensitive member unit are separately attachable/detachable to/from the apparatus main body.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-057651, filed on Mar. 22, 2016, which is hereby incorporated by reference herein in its entirety.

What is claimed is:

1. An image forming apparatus comprising:

a developer bearing member configured to develop an electrostatic latent image with developer, the electrostatic latent image being formed on an image bearing member;

a developer transporting member configured to rotate around a shaft and transport the developer toward the developer bearing member;

a frame supporting the developer bearing member and the developer transporting member, the developer transporting member being configured to contact the frame when the developer transporting member rotates; and an acquisition portion configured to acquire input printing mode information, the input printing mode information being one of a first image forming mode and a second image forming mode, wherein the image forming apparatus is configured to perform:

the first image forming mode in which an image is formed at a first peripheral velocity ratio representing a ratio of a peripheral velocity of the developer bearing member to a peripheral velocity of the image bearing member in a case where the input printing mode information acquired by the acquisition portion indicates the first image forming mode, and the second image forming mode in which an image is formed at a second peripheral velocity ratio representing a ratio of a peripheral velocity of the developer bearing member to a peripheral velocity of the image of the image bearing member, which is higher than the first peripheral velocity ratio in a case where the input printing mode information acquired by the acquisition portion indicates the second image forming mode, wherein a rotation number ratio of a rotation number of the developer transporting member to a rotation number corresponding to the peripheral velocity of the image bearing member in the second image forming mode is higher than that in the first image forming mode.

2. The image forming apparatus according to claim 1, further comprising:

a developing chamber; and a developer accommodation chamber, wherein the developer bearing member is arranged in the developing chamber, and the developer transporting member transports the developer from the developer accommodation chamber to the developing chamber.

3. The image forming apparatus according to claim 2, wherein the developing chamber is positioned above the developer transporting member, and the developer transporting member transports the developer upwardly from the developer accommodation chamber to the developing chamber.

4. The image forming apparatus according to claim 1, further comprising:

one common motor configured to drive both the developer bearing member and the developer transporting member.

5. The image forming apparatus according to claim 1, wherein developer transporting member transports the developer upwardly toward the developer bearing member.

* * * * *